United States Patent [19]

Blomqvist

[11] 4,314,649

[45] Feb. 9, 1982

[54] STACKABLE PALLET COLLAR

[76] Inventor: Berthold Blomqvist, Växjövägen, S-360 30 Lammhult, Sweden

[21] Appl. No.: 148,242

[22] Filed: May 9, 1980

[30] Foreign Application Priority Data

May 10, 1979 [DE] Fed. Rep. of Germany ... 7913519[U]

[51] Int. Cl.[3] ..... B65D 21/02; B65D 6/22

[52] U.S. Cl. ..... 220/4 F; 206/503; 206/509; 220/6

[58] Field of Search ..... 220/4 F, 6, 7; 206/503, 206/509

[56] References Cited

U.S. PATENT DOCUMENTS

| | | | |
|---|---|---|---|
| 1,337,167 | 4/1920 | Trego | 220/7 |
| 1,942,713 | 1/1934 | Klinka | 220/6 |
| 3,119,508 | 1/1964 | Wallace | 220/6 |
| 3,254,786 | 6/1966 | McWille | 220/6 |
| 3,966,072 | 6/1976 | Gonzales | 220/7 |

FOREIGN PATENT DOCUMENTS

| | | | |
|---|---|---|---|
| 1260720 | 4/1961 | France | 220/6 |
| 2410604 | 8/1979 | France | 220/6 |

*Primary Examiner*—George E. Lowrance

*Attorney, Agent, or Firm*—Dann, Dorfman, Herrel and Skillman

[57] ABSTRACT

A stackable metallic pallet collar in the form of a hollow rectangular frame which can be folded into compact form for storage. The collar consists of four side sections arranged in opposite pairs joined by means of hinged joints so that they can be folded together. The side sections are sheet metal and are provided with continuous longitudinal ribs arranged and dimensioned so that the longitudinal ribs of adjacent side sections which are connected by a common hinged joint nest within one another in pairs when the side sections are folded together around the common hinged joint. The upper and lower edges of the side sections are bent outwardly and down to permit stacking of the collars when extended.

7 Claims, 8 Drawing Figures

STACKABLE PALLET COLLAR

The invention concerns a stackable metallic pallet collar, which in folded-together position will occupy a smallest amount of space possible, can be stacked well in great number, does not cause any erection problems and provides good stability.

These objects are achieved by a stackable metallic pallet collar according to the invention, which is characterized by the following features.

(a) the collar consists of hollow frame having four side sections, which when extended provide two pairs of sides which are opposite to one another and parallel to one another, and are joined together by means of hinged joints so that they can be folded together;

(b) the side sections are equipped with continuous longitudinal ribs; and (c) the longitudinal ribs are arranged and dimensioned on the side sections in such a way that the longitudinal ribs on two adjacent sides sections which are connected by a hinged joint may nest within one another when the side sections are folded together around the common hinged joint.

Appropriately, the opposite side sections in each pair are equal in length, in the present instance one pair being shorter than the other. The sections have hinged joints at their ends which are arranged on the front side so that the stackable metallic pallet collar in extended position provides a rectangular base. It is particularly appropriate, if the longitudinal ribs are formed by means of outward bending or pressing out of a metal plate or sheet metal-like body material which forms the side sections, whereby the ribs preferably protrude inward in a direction away from the plane of the metal plate or sheet metal-like material. The longitudinal ribs are appropriately narrower in width than the longitudinal areas located between them which lie in the plane of the body material. In one pair of sections, at the lower side, the first longitudinal rib is appropriately positioned away from the edge at a distance which corresponds to the lateral distance of two consecutive longitudinal ribs. In the other pair of sections, at the upper side, the first rib is positioned away from the edge at a similar distance.

The side sections are according to a preferable embodiment joined with one another in such a way that the longitudinal ribs project inward toward the space which is enclosed by the collar. The longitudinal ribs themselves appropriately include diagonal lateral flanks which level out into the base area running parallel to the plane of the side section body whereby the flanks preferably form a 45° angle adjacent to it. According to a particularly preferable embodiment, the width of the longitudinal ribs, inclusive the lateral flanks which border them, corresponds to the width of the area which is located between the longitudinal ribs.

The hinged joints are preferably formed by projecting extensions of the bodies of the bordering side sections, each enclosing a pivot pin. The width of the projecting extensions corresponds substantially to the width of the longitudinal ribs and to the areas which lie between these. It is moreover favorable if outward projecting groove-like protrusions are constructed in the area of the hinged joints on the alternating, projecting extensions of the side sections. These protrusions on the one hand decrease the friction of the pivot pin and on the other hand they strengthen and protect the area of the hinged joints.

The folding together of the stackable metallic pallet collar is particularly facilitated if the depth of the longitudinal ribs correspond to the diameter of the pivot pin of the hinged joint.

According to a further particularly preferable embodiment, the stackable pallet collar includes an upper and a lower outward bent edge. The upper edge is thereby appropriately bent back in the shape of a U in direction of the side sections, which counteracts collection of dirt and has a reinforcing effect.

The same applies also for the lower edge, which is preferably bent in the form of a Z, whereby its free end extends somewhat parallel to the side sections and projects beyond them. In this way a construction is obtained wherein the hinged joint does not reach to the lower edge of the stackable metallic pallet collar, and in this way the hinged joints are protected. The lower edge, which can be turned back on itself upward at its extreme outer end for the purpose of further increase of stability, is generally wider than the upper edge.

According to a preferable embodiment, each lateral wall of the stackable metallic pallet collar contains three longitudinal ribs. The material of the stackable metallic pallet collar is preferably a sheet metal in which case steel sheet metal is particularly favorable.

The accompanying drawings of a preferable embodiment serve to further illustrate the invention.

The collar comprises a hollow rectangular frame 1 consisting of four side sections 2, 3, 4 and 5. Both of the short transverse side sections 2 and 4 as well as both of the long longitudinal side sections 3 and 5 are identically constructed. The sections 2, 3, 4 and 5 are joined so that they can be folded together at their corners by means of the hinges 6, 7, 8 and 9.

Figure 1:
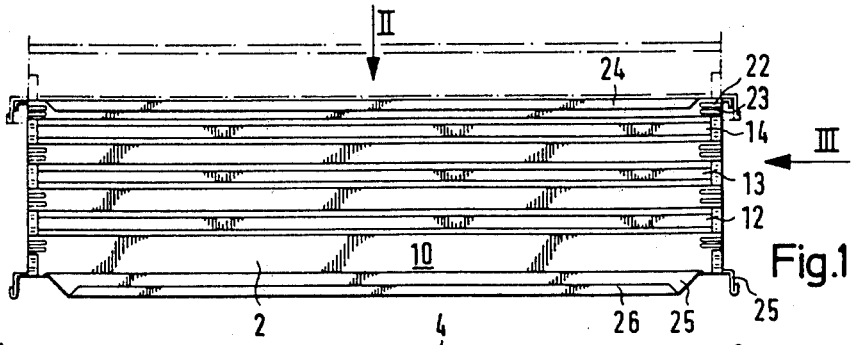
FIG. 1 shows a side view of a rectangular stackable metallic pallet collar seen from the narrower side.
Figure 2:
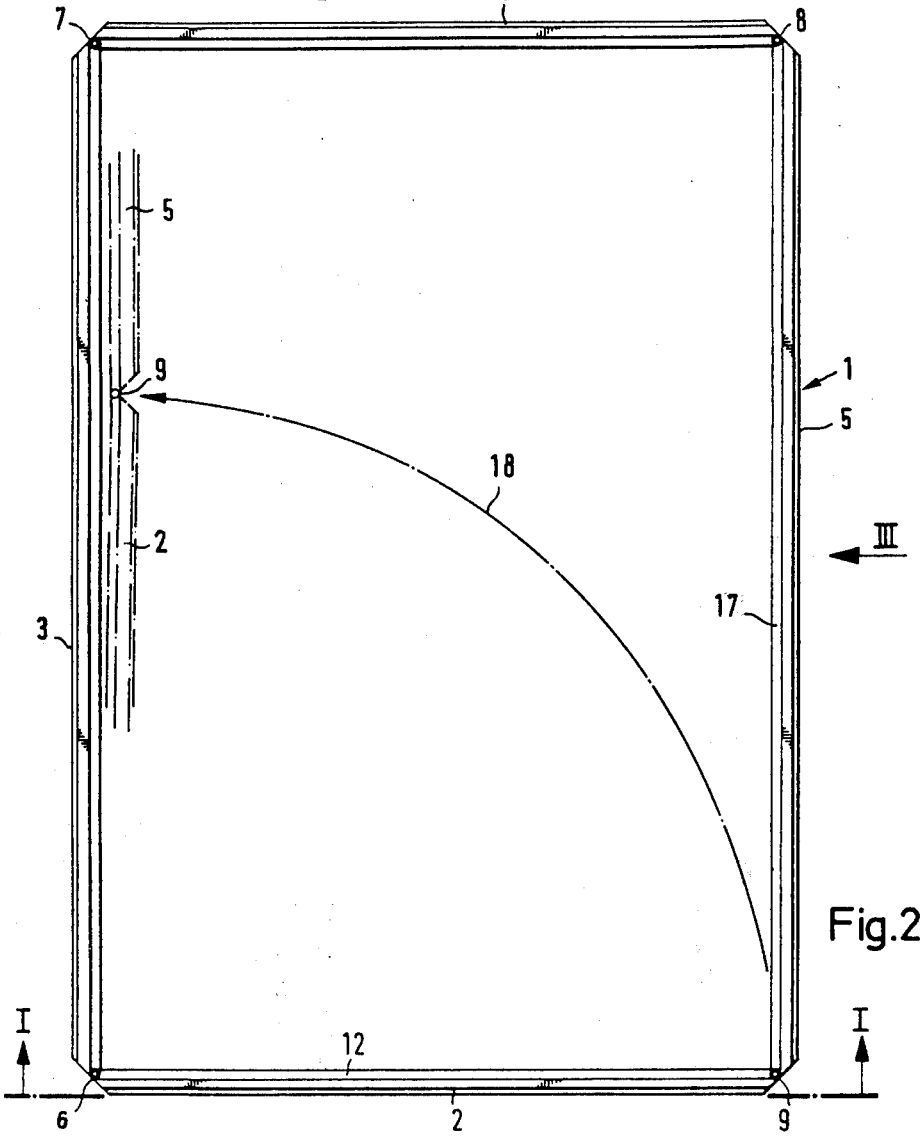
FIG. 2 shows a top view of the stackable metallic pallet collar direction of the arrow II of FIG. 1.
Figure 3:
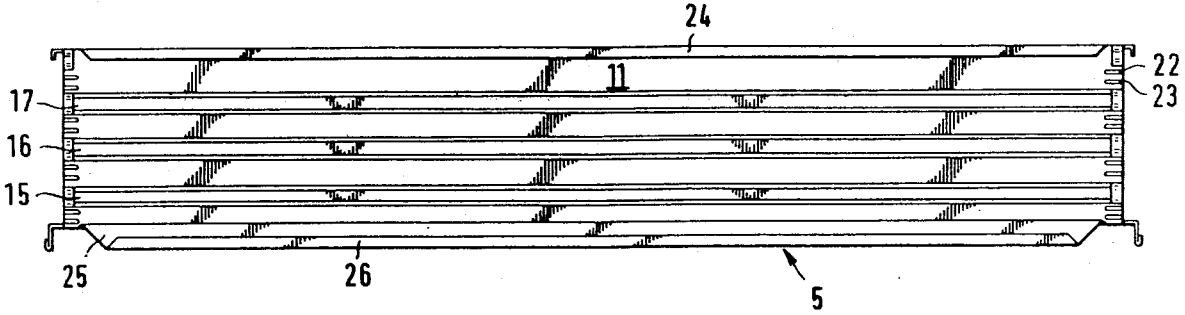
FIG. 3 shows a side view in direction of the arrows III of FIG. 1 and FIG. 2 from the longer side of the stackable metallic pallet collar.
Figure 4:
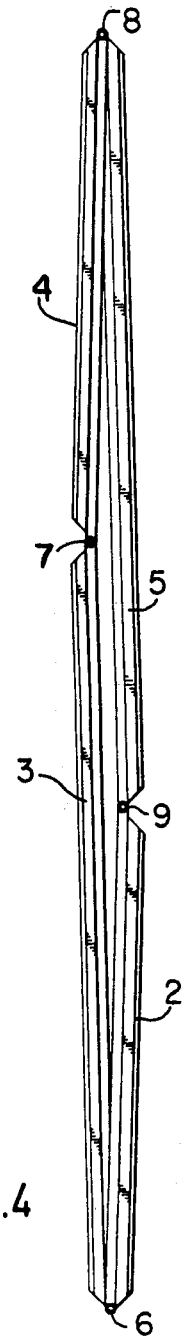
FIG. 4 shows a top view similar to FIG. 2 of the stackable metallic pallet collar when nearly completely folded together.
Figure 5:
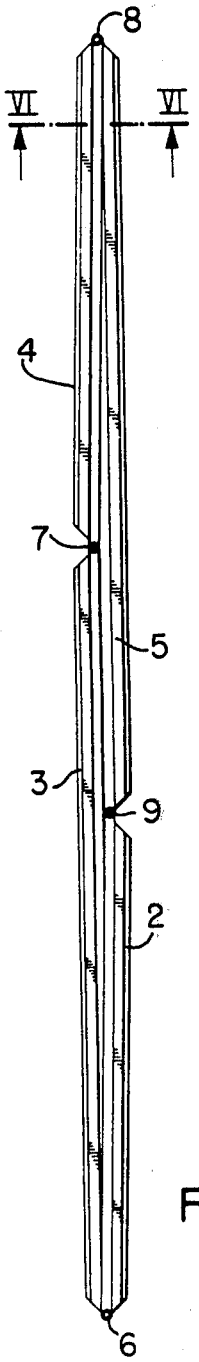
FIG. 5 shows a top view corresponding to that of FIG. 4 in which the stackable metallic pallet collar however is completely folded together.
Figure 6:
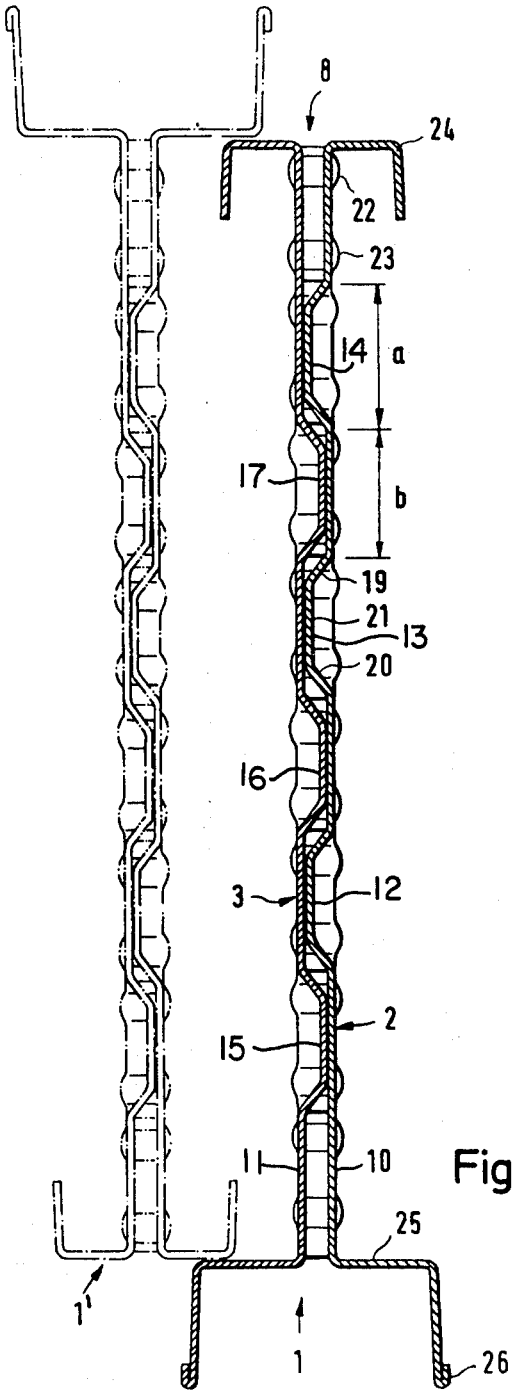
FIG. 6 shows a section along the line VI—VI of FIG. 5 through the folded-together stackable metallic pallet collar, demonstrating the ability to store a stackable metallic pallet collar of this type in a space-saving manner.
Figure 7:
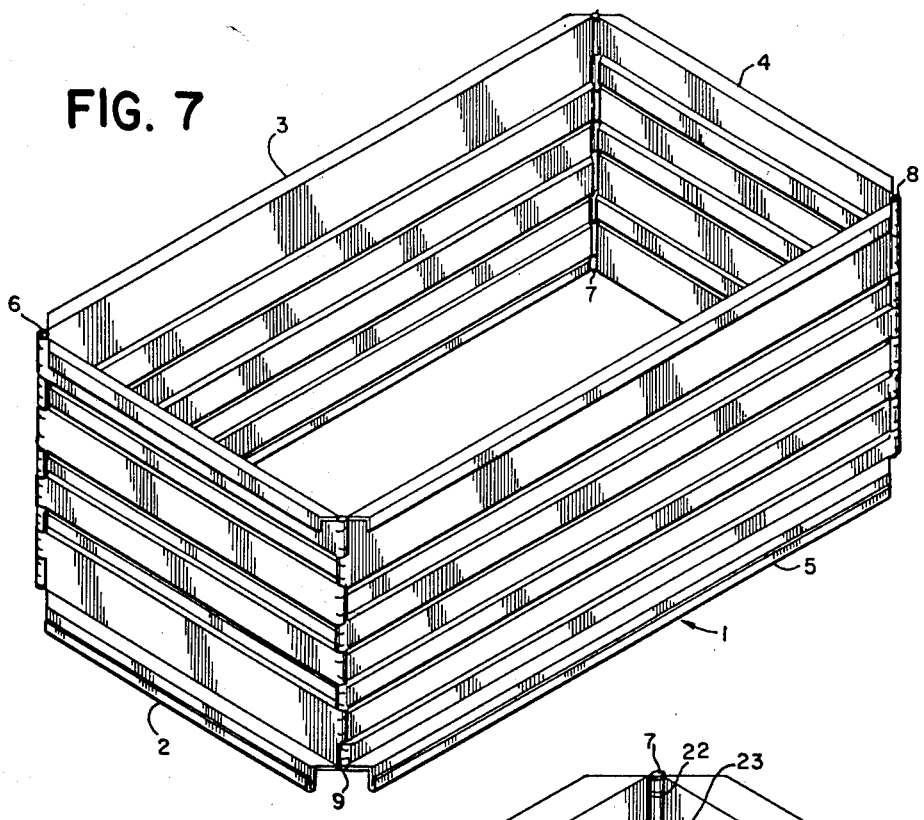
FIG. 7 is a perspective view of the collar in extended position.
Figure 8:
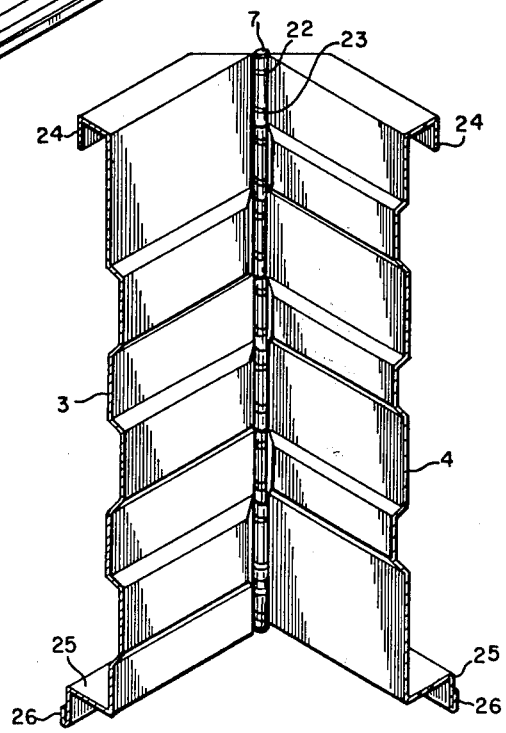
FIG. 8 is an enlarged fragmentary view illustrating the hinged joint between adjacent side sections of the collar.

As shown in FIGS. 1–3, the side sections consist of sheet metal or metal plate, of which the body of the longitudinal side sections 2 and 4, is indicated by the reference number 10, and the body of the other side sections 3 and 5, is marked with the reference number 11. Continuous longitudinal ribs are formed in the metal plate body of each of the side sections; in the illustrated embodiment there are three ribs per side section. The longitudinal ribs 12, 13 and 14 of the body 10 as shown in FIGS. 6 and 8, are arranged in staggered relation to the longitudinal ribs 15, 16, 17 of the body 11 of the adjacent side section which is connected by the hinged joint 9, in such a way that each longitudinal rib of one side section is located in the interval between two longitudinal ribs of the adjacent side section. The longitudinal ribs project from the plane of the metal plate bodies 10 and 11 like channels in the direction of the interior side of the stackable metallic pallet collar, whereby their depths, as revealed in FIG. 2, correspond to the diameter of the hinge pins of the hinged joints 6 through 9, which are constructed on the engaging corners of the side sections 2, 3, 4 and 5. In this manner, the ribs nest within each other when the side sections of the stackable metallic pallet collar are folded together as shown in FIGS. 2, 4 and 5, e.g., by means of an upward folding of the hinged joint 9 corresponding to the dashed and dotted arrow 18. As occurs in the situation indicated by the arc of the arrow, the side sections do not cause interference between the longitudinal ribs, and a unit is formed whose maximal thickness in the central area solely corresponds to double the thickness of the individual side sections. When the longitudinal ribs, which adjoin one another along a hinged joint, engage into one another, the thickness there is smaller, corresponding to the depth of a longitudinal rib.

As it is best revealed in the sectional view of FIG. 6, the longitudinal ribs have bottom portions 21 disposed in spaced parallel relation to the bodies 10 or 11 by lateral flanks 19 and 20 diagonally extending into the plane of the metal plate bodies 10 or 11, whereby the ribs with the flanks comprise an angle of 135°. With the same angle, the flanks pass into the bottom portion in a plane which extends parallel to the fixed plane of the metal plate bodies. The width a of the individual longitudinal ribs including their two lateral flanks corresponds to the distance b between the flanks of adjacent ribs. At the lower end areas of each side section body 10, no longitudinal rib is formed so that the body has a free area with a width at least as great as the width of a and b so that the adjoining metal plate can be folded into closed position there. At the upper end of each side section body 11, it has a free area with a width of at least a and b to accommodate folding of the adjacent side section. As it is likewise revealed in FIG. 6, that for every two side sections which adjoint one another, the free area of the one section is positioned upward and the free area of the other section is positioned downward.

It becomes clear from FIG. 6 that the hinged joints 6, 7, 8 and 9 all consist of hinge leaves which are extensions of the body portions 10 and 11 of the side sections 2, 3, 4 and 5. The ribs are cut away between the hinge leaves. The hinge-leaf extensions are bent toward one another to surround the hinge pins and form sockets, the sockets alternating between the side section bodies 10 and 11 which are interconnected by the hinge joint.

When the hinge is folded to close the frame as shown in FIGS. 4 and 5, the spacing between the body portions 11 and 12 corresponds to the diameter of the hinge pin.

The hinge leaves are provided with groove-like protrusions 22 and 23, preferably one adjacent the top edge and one adjacent the bottom edge of each hinge leaf to facilitate swinging movement of the leaves on the hinge pin.

The side sections 2, 3, 4 and 5 are reinforced at their upper ends by means of a U-shaped edge 24, which is bent over and downward. At their lower ends, a Z-shaped outward bent edge 25 has been planned, which is wider than the upper edge and which has a reversely-bent toe portion 26 extending upward at its free end.

Owing to the described embodiment, the folded-together stackable metallic pallet collar allows itself to be stored in a space-saving manner, as it is made clear through the example shown in FIG. 6 which is designated by 1 and 1'.

The embodiment of the upper and lower edge areas make it further possible, as indicated in FIG. 1, to place two stackable metallic pallet collars onto one another in such a way that the lower edge of the upper stackable metallic pallet collar engages in a tight fit over the upper edge of the lower stackable metallic pallet collar whereby a compact construction results. The edges 24 and 25 are obliquely cut off in the area of the corners.

I claim:

1. A stackable metallic pallet collar wherein the collar consists of four side sections arranged in opposite pairs joined by means of hinged joints so that they can be folded together to closed position, the side sections of each pair being of equal length and hinged at their ends to the side sections of the other pair to form a hollow rectangular frame when unfolded to open position, said hollow rectangular frame being capable of being stacked upon a frame formed by a like pallet collar, the side sections of each pair being a body of sheet metal having pressed-out portions providing a plurality of continuous longitudinal ribs in each side section spaced parallel to one another, and arranged and dimensioned in such a way that the longitudinal ribs of two adjacent side sections which are connected by a common hinged joint are staggered so that the ribs nest within one another in pairs when the side sections are folded together around said common hinged joint, said individual longitudinal ribs extending the entire length of the side sections from hinge to hinge, and including diagonal lateral flanks which level out into a base area running parallel to the plane of the side section body, the width of the longitudinal ribs inclusive the lateral flanks corresponding to the width of the area which is located between the longitudinal ribs, the upper and lower edges of said side sections being bent at right angles to the body and having means to enable the lower edge of the side sections of one pallet collar engage the upper edge of the side section of a like pallet collar in a tight fit.

2. A stackable metallic pallet collar according to claim 1, characterized in that at one edge of one pair of side sections, the first longitudinal rib is positioned away from the edge by a distance corresponding to the width of at least two consecutive longitudinal ribs, and at the opposite edge of the other pair of side sections the first rib is positioned away from the edge by a distance corresponding to the width of at least two ribs.

3. A stackable metallic pallet collar according to claim 1, characterized in that the longitudinal ribs project inwardly toward the space which is enclosed by the pallet collar.

4. A stackable metallic pallet collar according to claim 1, characterized in that the hinged joints are formed by extensions of alternating and projecting end areas of the body of said side sections, each extension being wrapped around to form a socket enclosing a pivot pin.

5. A stackable metallic pallet collar according to claim 4, characterized in that said extensions have groove-like protrusions projecting outward in the area of the hinged joints.

6. A stackable metallic pallet collar according to claim 1, characterized in that the upper edge is bent back in the shape of a U in the direction of the side section and that the lower edge is bent outward in the shape of a Z, whereby its free end projects somewhat parallel to the direction of the side section over it.

7. A stackable metallic pallet collar, according to claim 1, characterized in that each lateral wall contains three longitudinal ribs.

* * * * *